United States Patent [19]

Gronau

[11] Patent Number: 4,919,056

[45] Date of Patent: Apr. 24, 1990

[54] SHELF CONVEYING SYSTEM

[75] Inventor: Christian J. Gronau, Bergisch Gladbach, Fed. Rep. of Germany

[73] Assignee: Koettgen GmbH & Co. KG, Bergisch Gladbach, Fed. Rep. of Germany

[21] Appl. No.: 212,908

[22] Filed: Jun. 29, 1988

[30] Foreign Application Priority Data

Jul. 4, 1987 [DE] Fed. Rep. of Germany ..... 3722135

[51] Int. Cl.[5] ..... E01B 25/12

[52] U.S. Cl. ..... 104/130; 414/281; 104/105

[58] Field of Search ..... 414/281, 282, 283, 284, 414/265; 104/94, 95, 105, 121, 130, 139, 247

[56] References Cited

U.S. PATENT DOCUMENTS

| | | | |
|---|---|---|---|
| 624,427 | 5/1899 | Boynton | 104/121 |
| 3,049,083 | 8/1962 | Potter et al. | 104/94 X |
| 3,086,482 | 4/1963 | Fiegel et al. | 104/94 X |
| 3,126,839 | 3/1964 | Hampton et al. | 104/247 |
| 3,190,236 | 6/1965 | Leach | 104/94 X |
| 3,628,462 | 12/1971 | Holt | 104/105 |
| 3,780,666 | 12/1973 | Perrott | 104/105 X |
| 3,840,131 | 10/1974 | Castaldi | 414/281 |
| 3,902,428 | 9/1975 | Peveraro | 104/130 |
| 3,913,491 | 10/1975 | Auer, Jr. et al. | 104/130 |
| 4,068,598 | 1/1978 | Bardet | 104/105 X |
| 4,464,997 | 8/1984 | Dehne | 104/94 X |
| 4,532,385 | 7/1985 | Friske | 104/130 X |
| 4,620,486 | 11/1986 | Gronau et al. | 104/130 X |
| 4,658,731 | 4/1987 | Schumann | 104/247 X |
| 4,671,185 | 6/1987 | Anderson et al. | 104/130 |
| 4,702,173 | 10/1987 | Perrott | 104/130 |
| 4,721,043 | 1/1988 | Pudney et al. | 104/130 X |
| 4,768,442 | 9/1988 | Miller | 104/94 X |

FOREIGN PATENT DOCUMENTS

| | | | |
|---|---|---|---|
| 3446310 | 6/1986 | Fed. Rep. of Germany | 414/281 |
| 558594 | 4/1923 | France | 104/105 |
| 2286037 | 5/1976 | France | 104/139 |

OTHER PUBLICATIONS

"Gordern and Heben" Magazine, article titled A Contribution Toward . . . Storage and Retrieval Machines, pp. 808–809, author P. Gronau, 1983.

*Primary Examiner*—Robert J. Spar
*Assistant Examiner*—Robert S. Katz
*Attorney, Agent, or Firm*—Charles L. Schwab

[57] ABSTRACT

Shelf conveying system which is guided within one upper track system (8) and one ground track system (7), has driving bogies (3), which are supported by wheels (10) on two bearing surfaces of the track system (7) and are equipped with guide rollers (12), which abut laterally on the track system and can be removed at the branches for a straight-ahead path or to introduce branch paths. In addition, each driving bogie has at least one pilot roller (13) which extends into the gap between the bearing surfaces. The pilot roller (13) can be simultaneously designed as a track fastening element (14) which effectively connects with the track by contact with the back taper surfaces of the ground track system (7) (FIG. 3).

4 Claims, 5 Drawing Sheets

SHELF CONVEYING SYSTEM

TECHNICAL FIELD

This invention relates to a shelf conveying system which is guided within an upper track system and a ground track system by guide elements rotating about vertical axes, is supported on the bearing surfaces of the track system by wheels driven by driving gears and is equipped with guide rollers which engage laterally with the track system and can be removed at the branches for running straight ahead or for movement into a branch path at one side of the track system.

PRIOR ART STATEMENT

A shelf conveying system of the prior art has one single wheel per driving bogie which is supported on the even surface of a single track. Each driving bogie has, in addition, two guide rollers per side which, when running straight ahead, guarantee the guidance of the driving bogie on the track and which are lifted on one side when encountering branches of the track being traveled. At a branch it is necessary, for the guide rollers which are not then lifted, to provide an outer additional track so that the rollers cannot run off the bearing surface of the ground track. This results, at least in the branch area, in a complicated and expensive ground track system. In addition, the prior art shelf conveying system has rail fastening elements which are combined with the guide elements into one unit, but which, in connection with the single-bearing surface system and the additional track, have the disadvantage that the rail fastening and guide elements are not folded back, but rather lifted in the area of the branches, so that grooves in the bearing surface are necessary so that the rail fastening elements can be released from the back taper of the bearing surface of the track.

OBJECTS AND SUMMARY OF THE INVENTION

The object of the present invention is, therefore, that of improving the prior art shelf conveying system so that, on the one hand, economical tracks can be chosen and that, on the other, a rail fastening system is available if needed which operates in a maintenance free manner and is economical to fabricate. In addition, the supporting power and travelling stability of the shelf conveying system will be improved.

This objective of the invention is met to a substantial degree by the fact that the ground track system has two load bearing surfaces or rails which are arranged parallel to one another and connect to each other without transition in the area of the branches; that each driving bogie has two drive wheels which are supported, respectively, on two bearing surfaces; and that each driving bogie has at least one pilot roller which extends into the gap between the bearing surfaces. By using a pair of tracks, the load bearing rails and their bearing surfaces can be continuous, thus permitting track sections to be welded together in a simple manner. In addition to this, commercial tracks and/or profiles can also be used. The bearing surfaces of the tracks are spaced a relatively small distance apart, so that a compact driving bogie with a narrow wheel base results. Also, by using two bogies, each with two wheels, the shelf conveying system has a high load capacity and a high level of travelling stability, since, with only very few exceptions at the branches, both wheels are supported on bearing surfaces. In addition, high travelling speeds can be reached, since the guiding rollers can be controlled long before reaching the branch points in track, so that a relatively trouble-free run is achieved in connection with the guide rollers.

The ground track system may have a U-shaped profile with two bearing surfaces extending horizontally from the tops of the side legs. In the simplest design, the upper edges of the side leg may, if the side legs are relatively strong, form the respective bearing surfaces, However, additional bearing surfaces may also be added—for instance, welded on—to the free ends of the side leg. The ground track system can, however, consist of two separate U-shaped tracks which are spaced from one another. In this case the rollers are supported on the U-side legs. The bearing surfaces may be secured at right angles to the side legs, so that either a box profile results which has an upper gap, or an open U-profile results with the bearing surfaces extending laterally outwards.

The ground track system may be made up of individual tracks arranged parallel to one another which, when viewed in cross-section, are designed to be shaped like a double "T." In such case the pilot roller engages the confronting side surfaces of the rails and the guide rollers engage the outer side surfaces of the rails.

Each driving bogie may have at least one rail fastening roller which forms a single unit with the pilot roller. The pilot and fastening roller unit can in this case be designed to rotate about a vertical axis and the diameter of the rail fastening roller is greater than the diameter of the pilot roller. The pilot roller may have an enlarged diameter rail fastening roller, the diameter of which is greater than the clearance between the bearing surfaces or rails. It is obvious that the pilot roller unit may include one or more individual travelling rollers which can be rotated about horizontal axes and which contact the back taper surface on the underside of the rail presenting the bearing surface. In addition, the pilot roller and the rail fastening roller can also be combined to form a design unit in such a way that separate rollers are provided for the various functions. It is very important that the pilot roller and also especially the rail fastening roller can be designed as position-secured design units which also function like a sliding block. In a simple and economical way, the wheels can also have track rims or flanges on their inner sides which extend into the gap between the bearing surfaces and therefore function as pilot elements.

Outer rail fastening elements may be provided in a known manner at the outer back taper profiles of the bearing surfaces or rails which can be removed from the bearing surfaces and/or the back taper profile in the area of the branches. Since, as has already been pointed out, no additional or auxiliary profiles are necessary, the removal of the outer rail fastening elements can be carried out by means of a simple upward retracting arrangement, so that a simple mechanism results. Even if the outer or, as the case may be, additional rail fastening elements form one design unit with the guiding elements, this does not change the simple actuation of the guiding elements in connection with the rail fastening elements.

In one embodiment of the invention the shelf conveying vehicle is suspended from an upper track system, whereby the ground track system performs only a guiding task. In this case the ground track system and the ground driving bogies of the previously described embodiment can be designed into the upper track system. A simple U-track can be provided in which guide rollers rotate about vertical axes and in which pilot rollers can also be provided if needed. The guide rollers which accept the load for the shelf conveying vehicle are very important in the area of the driving bogies. In the case of driving bogies which also provide the sole support, the guide elements may be deleted. An appropriate shifting of the vehicle frame from a straight-ahead path to a branch path is achieved by the load-accepting driving bogies, so that the driving bogies which do not accept a load also turn in the appropriate direction.

The upper track system also has two bearing surfaces which are arranged parallel to one another and also connect with each other without transition in the area of the branching. Each of the upper driving bogies has two rollers which are subordinated to the bearing surfaces, so that here as well good guidance and strong support are guaranteed. The upper track system can be designed to correspond to the previously described ground system, in which case, however, only those solutions can be considered which have bearing surfaces or rails which have back taper surfaces. In this case, the guidance of the shelf conveying vehicle is accomplished in a similar manner by at least one pilot element each, which can be designed as a roller that can be rotated around a vertical axis which extends into the gap between the bearing surfaces. Thus the axis of the driving bogies can form a T-shaped unit with the axis of the pilot rollers. Of course, there are also other solutions for the pilot element which have already been described. The task of the guide elements can also be taken over, in the case of the upper driving bogies, by the wheels without requiring any additional design modifications, since the upper bearing surfaces are designed as back taper surfaces, and the bearing surfaces are laterally limited by the vertical leg surfaces which serve to guide the driving bogies. Additional guidance is also not necessary in the case of branching since the corresponding guide element or, as the case may be, pair of guide elements assumes the guiding function.

The guidance of the upper driving bogies in the case of branching may be carried out, in substantially the same way as described for the ground track driving bogies, by guide elements which are each arranged on the outer edge or surface of the upper track system. These guide elements may, however, also exhibit additional wheels and/or be designed as wheels, which are effectively connected with outer bearing surfaces as back taper surfaces. The wheels can, as is described in greater detail above in connection with the guide elents, also assume the guide function. These wheels are then, as the case may be with the guide elements, removed from the upper track system corresponding to the branch path direction. The shelf conveying system with a suspended shelf conveying vehicle has, in addition, the advantage that the ground track can be designed more simply and more space-efficiently, so that there are only minor impediments in the ground area. In addition, the frame of the shelf conveying vehicle and/or the mast is loaded only with tension forces, so that the mast, since it is not burdened by compression tending to cause buckling, can be a lighter construction.

The driving bogies which carry and/or hold the shelf conveying vehicle, as well as the other driving bogies, can be designed to be gearless and contact-free, and in particular to be carried out by a magnetic suspension system. In this case the actuation is also carried out magnetically by means of a linear motor and the braking is magnetic. Here the driving bogies of the upper track and ground track systems can also be designed in accordance with magnetic suspension technology. Since the support and tilting forces can be assumed by a synchronic regulation of the driving bogies, the number of driving bogies can be reduced, so that, depending on the load of the vehicle and the distance between the track systems, one upper track bogie and one ground track driving bogie are sufficient. In addition, the guiding and conducting elements can also be deleted, since controlling of the shelf conveying vehicle in the area of the branching and/or guidance along straight stretches can be carried out by an appropriate guidance of the support magnets or by means of additional magnets or magnet systems.

In addition, a better distribution of load for both track systems is achieved with these magnetic suspension drive bogies, since a certain balancing of length and/or clearance can be achieved between the upper and ground tracks relative to the height of the shelf conveying vehicle.

BRIEF DESCRIPTION OF THE DRAWINGS

To provide further description of the invention, the drawings illustrate several embodiments of the invention, in which.

DETAILED DESCRIPTION OF THE DRAWINGS

Figure 1:
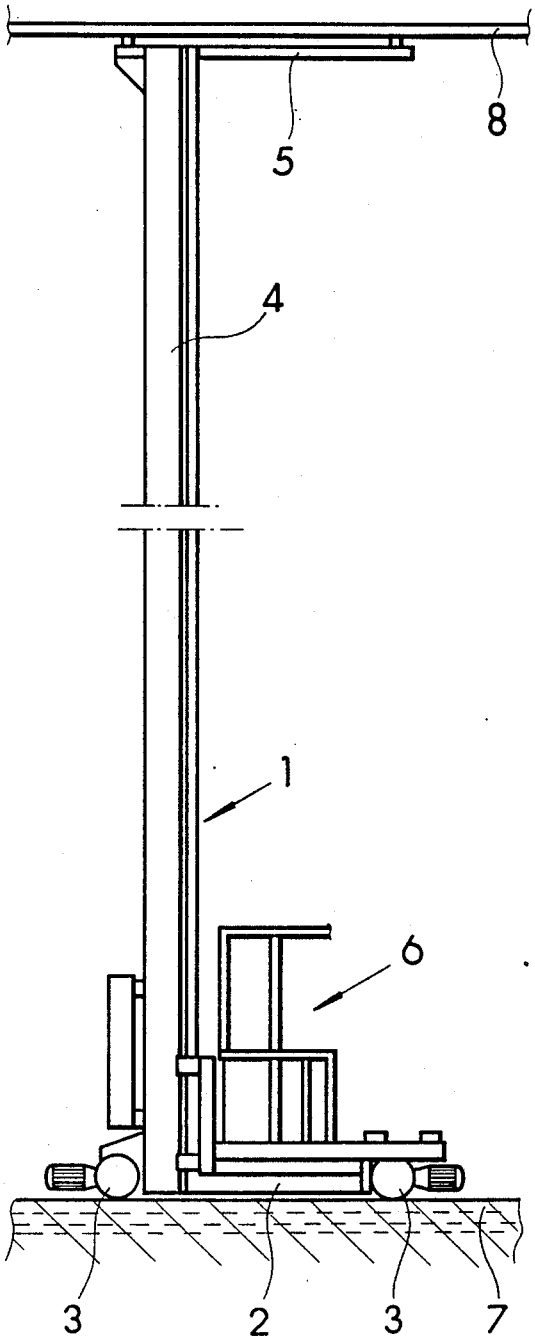
FIG. 1 is a side view of a shelf conveying system which is guided within an upper track and a ground track system.
Figure 2:
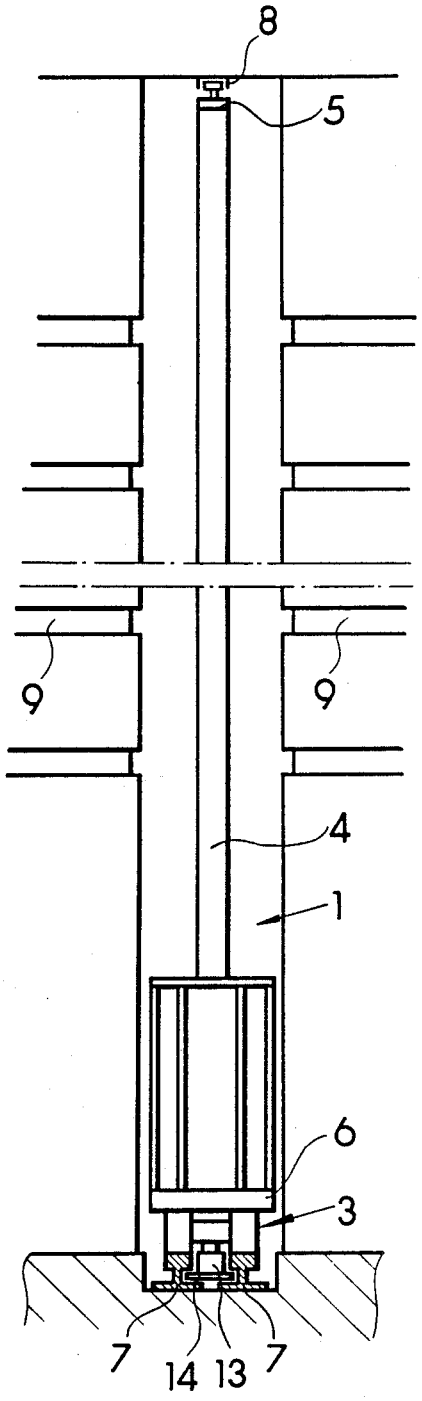
FIG. 2 is a view of the shelf conveying system of FIG. 1 looking in the aisle direction of the system, with shelves indicated schematically at laterally opposite sides of the aisle.

In FIGS. 1 and 2 a shelf conveying vehicle 1 includes a lower vehicle frame 2 with two driving bogies 3, a mast 4 and an upper vehicle frame 5. In addition, the vehicle 1 includes a lift carriage 6, which can, in a known way, lift and remove loads at various points. The shelf conveying vehicle 1 is guided in a ground track system 7 and in an upper track system 8. Shelves 9 are arranged laterally from the shelf conveying vehicle 1, as illustrated in FIG. 2.

Figure 3:
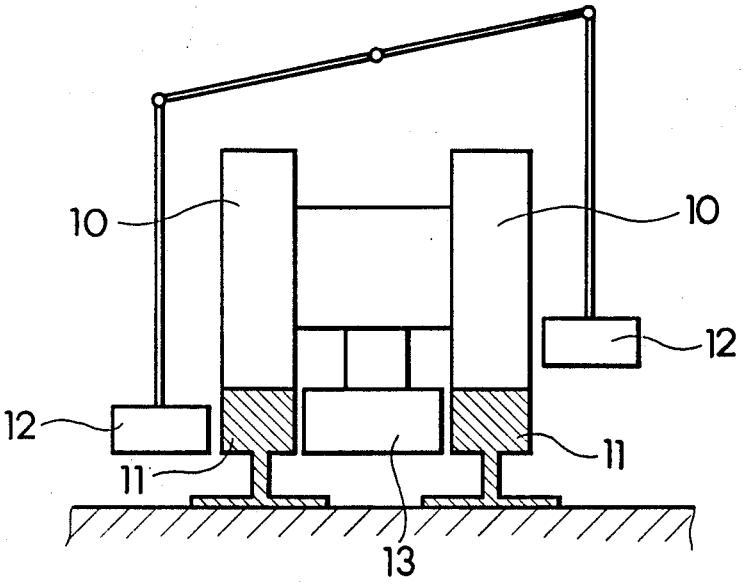
FIG. 3 is an enlarged view of the driving bogie, with a corresponding ground track system.
Figure 4:
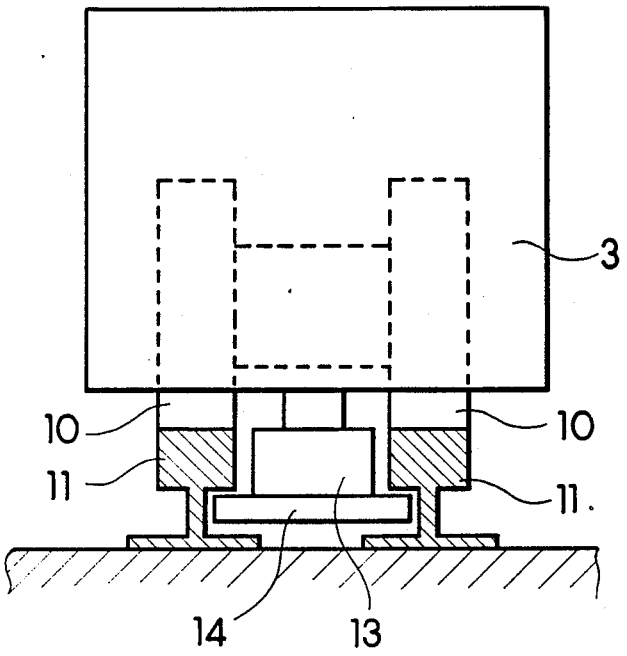
FIG. 4 is a view of a driving bogie in which a piloting and rail fastening element are combined into a single unit.

As is illustrated particularly in FIGS. 3 and 4, each driving bogie 3 has two coaxial drive wheels 10. It is, however, not necessary that the two wheels be arranged on a common axis or a common shaft; they can also be supported individually on the driving bogie. The wheels 10 are supported, as shown in FIGS. 3 and 4, on double T-shaped tracks which are secured to the ground. The lateral guide elements 12 shown in FIG. 3 are designed as travelling guide rollers. They can both be lowered for a straight-ahead path so that the guide rollers assume the function of guiding the driving bogie. The important task of the guide rollers 12 is controlling the driving bogie in the area of the branching into the desired path direction, whereby one guide roller, or guide roller set, is lowered to perform the guiding function and the guide roller, or set, on the opposite side is lifted over the bearing surface of the ground track system. Each driving bogie has a pilot element indicated by the reference number 13, which is designed in FIG. 3 as a pilot roller, which can be rotated around a vertical axis and which is fastened to the driving bogie. This pilot roller remains constantly lowered so that it serves to pilot the driving bogie. In addition, however, the pilot roller also achieves a piloting function in the branching area such that the driving bogie cannot leave the ground track system in the direction of the lowered guide rollers so that an additional track profile for the guide rollers can be deleted.

The pilot roller 13 is modified in FIG. 4 in such a way that it has an additional rail fastening element in the form of a roller 14. This enlarged diameter rail fastening roller 14 is sufficiently large to effectively engage or interlock with the back taper surfaces on the underside of the rails of the double T-shaped tracks 11.

Figure 5:
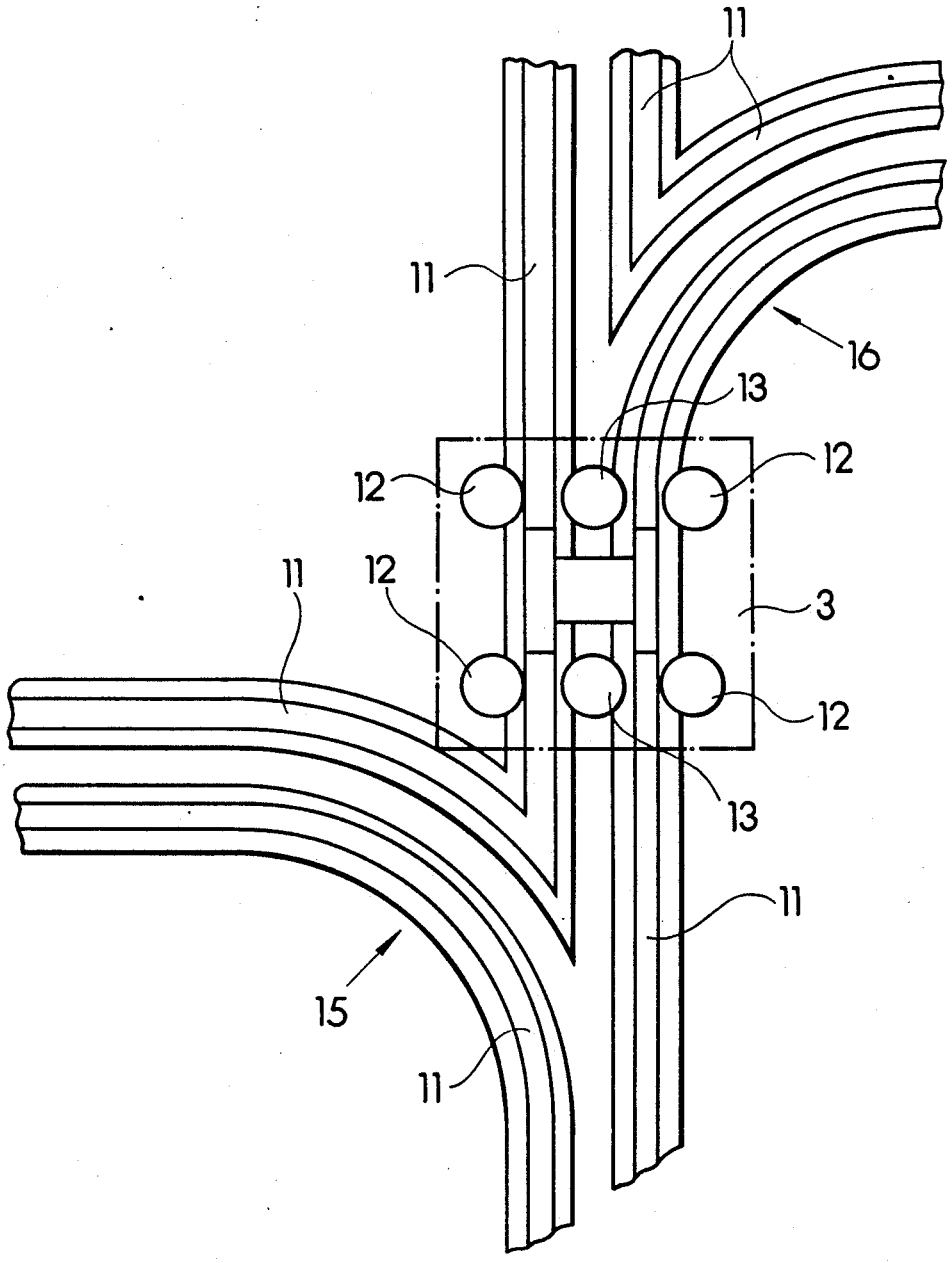
FIG. 5 is an overhead view of a track system with one left-side branch and one right-side branch, and wherein the ground track system consists of two tracks which are formed substantially as a double "T" and in which an outlined driving bogie is also shown.

The double T-shaped tracks 11 represented in cross-section in FIGS. 3 and 4 are shown in FIG. 5 in a top view, in which a left-side branch of the tracks is indicated by 15 and a right-side branch of the tracks is indicated by 16. In addition, a driving bogie 3 is represented in the overhead view of FIG. 5 whereby the wheels 10, the guide rollers 12 and the pilot rollers 13 are shown.

Figure 6:
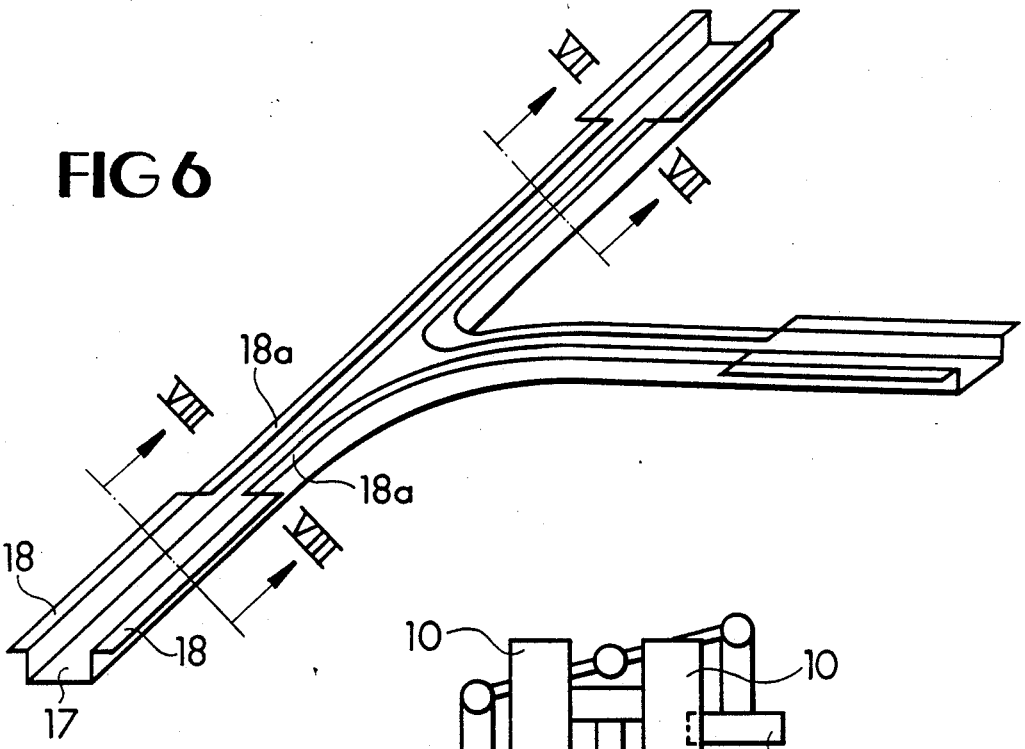
FIG. 6 is a perspective view of a modified ground track system with one branch in which the ground track system has substantially a U-shaped profile with attached bearing surfaces.
Figure 7:
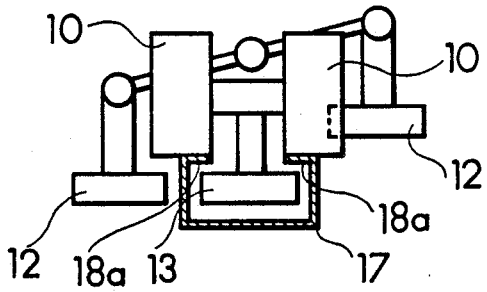
FIG. 7 is a section view of the ground track system taken on the line VII—VII in FIG. 6 with an outlined driving bogie.
Figure 8:
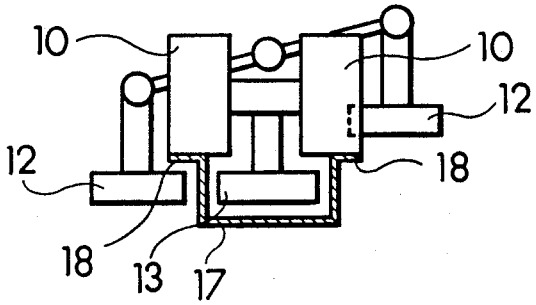
FIG. 8 is a section view of the ground track system taken on the line VIII—VIII in FIG. 6 with the corresponding driving bogie in outline form.

The ground track system of FIG. 6 is differentiated from that represented in FIGS. 3 through 5 in that, when seen in cross-section, a U-shaped track 17 is provided to which rails with horizontal load bearing surfaces 18 and **18*a* are fastened. The bearing surfaces 18 are secured to the top of the vertical side legs of the U-shaped track 17 and extend laterally outward therefrom, while the bearing surfaces 18*a* extend laterally inward towards one another from the top of the vertical side legs of the U-shaped track 17, so that they then form back taper surfaces. It is also particularly easy to see these connections in FIGS. 7 and 8. The driving bogies outlined in FIGS. 7 and 8 are not different in principle from those driving bogies represented in FIGS. 3 through 5 and are therefore provided with the same reference numbers. It is important that somewhat wider wheels 10 are provided corresponding to the combined width of the bearing surfaces 18 and 18*a*** so that they are supported regardless of which bearing surface the wheels engage.

The track design in FIG. 6 has the advantage that it offers a widened support surface for the driving bogie in the areas of the straight-ahead stretches of the ground track system, whereby the rail fastening function is carried out by the mobile guide rollers 12, while in the branching areas the pilot roller 13 assumes the rail fastening function and a simple lifting of the guide rollers can take place in these areas.

Figure 9:
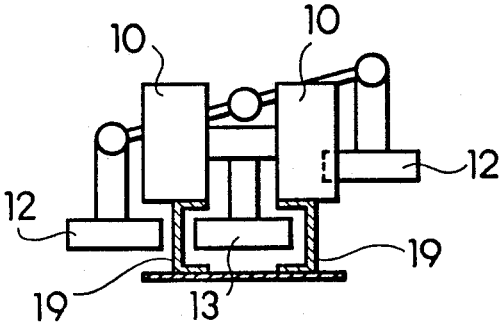
FIG. 9 is a section view of a ground track system having two U-shaped tracks, the legs of which are set up parallel to each other, with a driving bogie in outline form.

The ground track system outlined in FIG. 9 differs from the ground track system shown in FIG. 6 mainly in that two U-shaped tracks are provided, the legs of which are designed parallel to one another and in which the outer surfaces of the side legs serve as bearing surfaces. They can in an advantageous way have ordinary U-profiles, in cross section, which are arranged at an appropriate distance from each other. If the side legs of the U-profiles have bearing surfaces extending towards each other, the guide roller will complete the rail fastening function, while with the other design of the U-profiles, outer rail fastening rollers can, if desired, be used.

Figure 10:
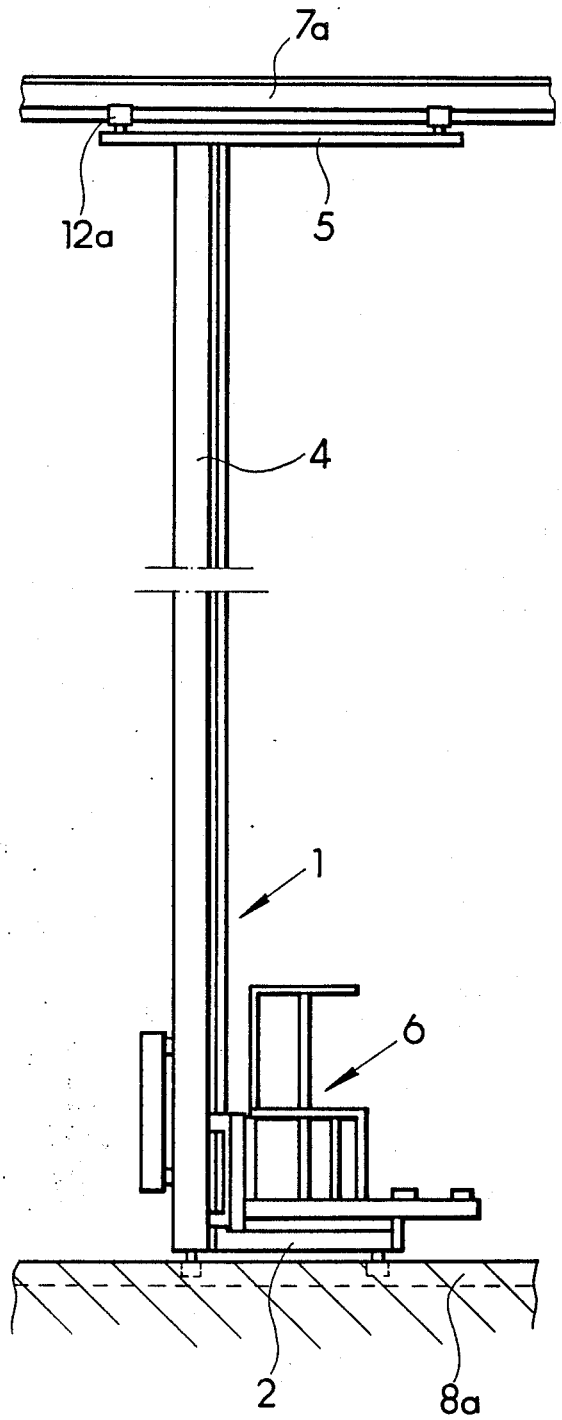
FIG. 10 is a side view of a shelf conveying system similar to FIG. 1, but in which the shelf conveying vehicle is suspended from an upper track system.
Figure 11:
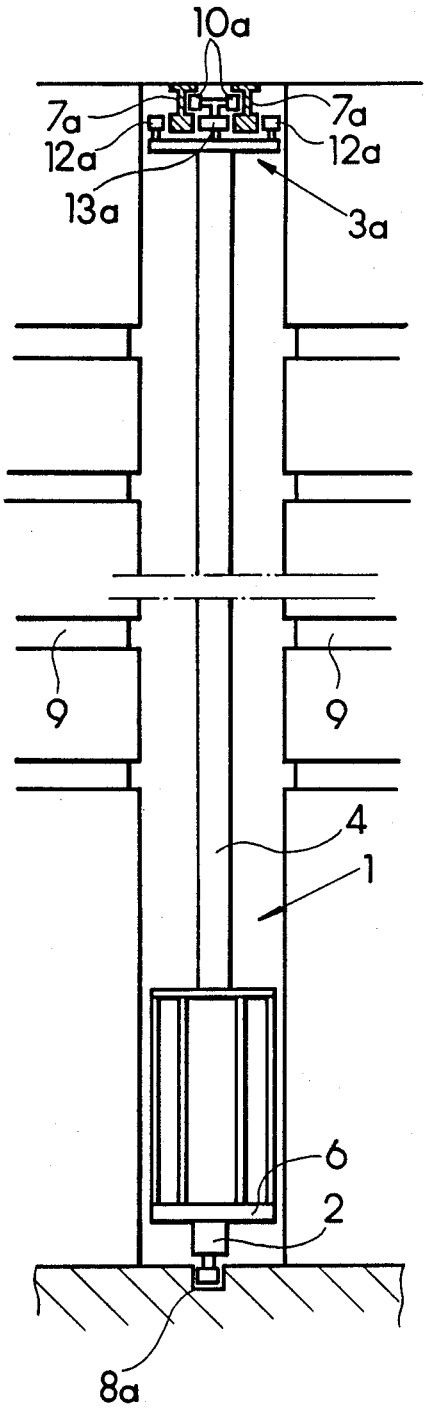
FIG. 11 is a view of the shelf conveying system shown in FIG. 10 looking in the aisle direction of the system.

With the shelf conveying system represented in FIGS. 10 and 11, the upper track system is, for the most part, exchanged with the ground track system. Therefore the upper track system is indicated in FIGS. 10 and 11 by **7*a* and the ground track system by 8*a*. The upper track driving bogies are indicated by 3*a*, the wheels by 10*a*, the guide rollers by 12*a* and the pilot roller by 13*a*. It is obvious that the wheels of the upper driving bogies are driven via electro-motors and gears. These are, however, not shown in FIGS. 10 and 11. The design of the shelf conveying system of FIGS. 10 and 11** also corresponds otherwise to the previously described shelf conveying system.

The embodiments of the invention in which an exclusive property or privilege is claimed are defined as follows:

1. A shelf conveying system having a shelf conveying vehicle (1) guided within an upper track system and a ground track system having branch paths and driving bogies having track wheels engaging the rails of one of said track systems and equipped with guide rollers which laterally engage the track system and can be removed at the branches for running straight ahead or for the movement into branch paths of the track system, characterized by said ground track system (7) supporting the weight of said vehicle, said ground track system having a pair of rails arranged parallel to one another and providing a continuous support path without transition in the area of the branch paths (15, 16); each of said rails having an upstanding leg and bearing surfaces extending laterally from the top of said legs, said bearing surfaces extending only laterally inward toward one another from said legs in the area of the branch paths and said bearing surfaces extending laterally outward in areas of the ground track system other than the areas of the branch paths; each of said driving bogies (3) having two wheels (10) in load bearing engagement with said bearing surfaces; each of said driving bogies (3) having at least one pilot roller (13) which extends into the space between said legs and said guide rollers being in confronting engageable relation to the laterally outer sides of said legs and being selectively movable upward out of engagement with said legs in the areas of said branch paths.

2. The shelf conveying system of claim 1, wherein said ground track system has a U-profile track (17).

3. The shelf conveying system of claim 1, wherein said track system (7) includes two U-shaped tracks (19).

4. The shelf conveying system of claim 1 wherein said wheels are sufficiently wide to be in full load bearing engagement with said bearing surfaces extending laterally inward and laterally outward from said legs of said rails.

* * * * *